United States Patent [19]

Warther et al.

[11] Patent Number: 4,978,146

[45] Date of Patent: Dec. 18, 1990

[54] METHOD FOR MAKING UNIQUELY ENCODED TRANSACTION CARDS AND RELATED SHEET PRODUCTS

[75] Inventors: Richard O. Warther, West Chester; Raymond Steen, Jr., Chester Springs, both of Pa.

[73] Assignee: The Vanguard Group of Printing Companies, Exton, Pa.

[21] Appl. No.: 502,005

[22] Filed: Mar. 30, 1990

[51] Int. Cl.[5] ..... B42D 15/00

[52] U.S. Cl. ..... 283/81; 283/117; 283/904; 101/369

[58] Field of Search ..... 283/81, 117, 904; 281/5; 156/277; 101/483, 369

[56] References Cited

U.S. PATENT DOCUMENTS

| | | | |
|---|---|---|---|
| 3,068,140 | 12/1962 | Biddle | 101/369 |
| 3,152,901 | 10/1964 | Johnson . | |
| 3,364,049 | 1/1968 | Deak et al. | 283/904 |
| 3,583,317 | 6/1971 | Gibson . | |
| 3,674,622 | 4/1972 | Plasse | 101/369 |
| 3,676,644 | 7/1972 | Vaccaro et al. . | |
| 3,679,448 | 7/1972 | Trampoach . | |
| 3,679,449 | 7/1972 | Nagot et al. . | |
| 3,697,101 | 10/1972 | Loos et al. | 281/5 |
| 3,716,439 | 2/1973 | Maeda . | |
| 3,716,440 | 2/1973 | Ando et al. . | |
| 4,006,050 | 2/1977 | Hurst et al. . | |
| 4,204,639 | 5/1980 | Barber et al. | 283/81 |
| 4,271,352 | 6/1981 | Thomas . | |
| 4,523,088 | 6/1985 | Utsch et al. . | |
| 4,536,013 | 8/1985 | Haghiri-Therani et al. | 283/904 |
| 4,589,687 | 5/1986 | Hannon . | |
| 4,630,067 | 12/1986 | Teraoka . | |
| 4,637,635 | 1/1987 | Levine | 283/81 |
| 4,637,712 | 1/1987 | Arnold et al. | 283/117 |
| 4,641,347 | 2/1987 | Clark et al. . | |
| 4,653,775 | 3/1987 | Raphael et al. . | |
| 4,712,929 | 12/1987 | Kitaoka . | |
| 4,857,121 | 8/1989 | Markley et al. | 156/277 |

OTHER PUBLICATIONS

Single sheet entitled "000363 Stop & Shop Video (Card)" 001-Sets 07/17/8.

*Primary Examiner*—Frank T. Yost
*Assistant Examiner*—Hwei-Siu Payer
*Attorney, Agent, or Firm*—Panitch Schwarze Jacobs & Nadel

[57] ABSTRACT

A printed sheet product comprises a thin core having a pair of opposing major planar sides. A plurality of sets of code fields are printed on a first side of the core. Each set of code fields is printed with a numeric code unique to the set. At least a first code field of each code field set is printed with the unique numeric code in at least a bar format. At least a second code field of each code field set is printed with the unique numeric code in at least a numeral format. The second code field of each set is spaced from the first code field of the set. A sheet product further comprises a layer of pressure sensitive adhesive applied to at least part of at least one side of the sheet product directly opposite at least part of at least one of the first and second code fields of each code field set printed on the first side of the core.

18 Claims, 3 Drawing Sheets

METHOD FOR MAKING UNIQUELY ENCODED TRANSACTION CARDS AND RELATED SHEET PRODUCTS

FIELD OF THE INVENTION

The invention relates to the manufacture of sheet products and the products made and, in particular, to sets of uniquely encoded transaction cards, tags, labels and other sheet elements.

BACKGROUND OF THE INVENTION

A substantial market has developed in recent years for inexpensively manufactured, individually encoded, transaction cards for such uses as store credit cards, membership cards, I.D. cards, etc. The transaction cards typically bear the code in a bar format to permit automatic machine scanning of the card. Such cards typically are supplied in sets with one or more labels, tags, etc. being supplied with each card and bearing the same individual code number as the card for attachment to application forms, membership lists, etc.

Previously, it has taken many separate manufacturing steps to provide such sets. Perhaps the most efficient prior method has been printing in multiple steps, individual sheets of uniquely encoded, typically sequentially numbered, transaction cards, printing separate strips of release paper back adhesive labels with the same, unique codes as the cards, in the same sequence of codes as the codes appear on the cards of the sheets, and attaching the strip(s) with the appropriate code numbers to each sheet with the labels adjoining the like coded card(s).

In practice, this apparently simple, straightforward method requires several labor intensive steps. The appropriate labels for each sheet of cards must be identified and applied by hand to the sheet so that the labels properly adjoin the associated transaction cards. Because this correlation of the separate elements of each sheet is done by hand, considerable time and effort also must be spent in checking the final product to assure accuracy.

In addition, because the transaction card sheets and label strips must be printed separately, more time is needed to complete the task if the same printer is used to print the transaction card sheet and label strips. Alternatively, several printers must be available to simultaneously print the cards and the strips.

The present invention is directed to solving the twin problems of relatively high cost and errors associated with hand production of sets of plural related printed elements, all bearing some code unique to each set of elements, by eliminating hand collation and assembly of the separate elements into the sets.

The present invention is also directed to solving the problem of the numerous printing steps which are currently required to produce related sets of card sheets and separate label strips, by reducing the number of required printing steps.

SUMMARY OF THE INVENTION

In one aspect, the invention is directed to a method of making a printed sheet product comprising the step of printing a plurality of sets of code fields on a first of two opposing major planar sides of a thin core, each set of code fields being printed with a numeric code unique to the set. The unique numeric code of each code field set is printed in at least a bar format in at least a first field of each set and in at least a numeral format in at least a second field of the set. The second code field of each set is spaced from the first code field of the set on the first side of the core. The method further comprises the step of applying a layer of pressure sensitive adhesive to the second side of the core opposite at least part of at least one of the first and second printed fields of each code set on the first side of the core. The invention further comprises the sheet produced by the foregoing method.

In another aspect, the invention is directed to the method of making a printed sheet product comprising the step of printing a plurality of code field sets on a first of two opposing major planar sides of a thin core, each set of code fields being printed with a numeric code unique to the set. The unique numeric code of each code field set is printed in at least the bar format in at least the first field of each set and in at least a numeral format in at least a second field of the set. The second code field of each set is spaced from the first code field of the set on the first side of the core. Each of the codes in the first code field of each code field set is printed in a first direction across the first side of the core. Each of the codes is printed in the second code field of each code field set in a direction transverse to the first direction of the first code field of the set. The method further comprises scoring the core to define a plurality of sets of elements removable from the core, a first element of each set of the removable elements bears the first code field of one of the sets of printed code fields. A second element of each set bears the second code field of the one set of printed code fields. The invention further comprises the sheet product produced by the foregoing method.

In another aspect, the invention is a printed sheet product comprising a thin core having a pair of opposing major planar sides. A plurality of sets of code fields are printed on a first side of the core. Each set of code fields is printed with a numeric code unique to the set. At least a first code field of each code field set is printed with the unique numeric code in at least a bar format. At least a second code field of each code field set is printed with the unique numeric code in at least a numeral format. The second code field of each set is spaced from the first code field of the set. A sheet product further comprises a layer of pressure sensitive adhesive applied to at least part of at least one side of the sheet product directly opposite at least part of at least one of the first and second code fields of each code field set printed on the first side of the core.

In another aspect, the invention is a printed sheet product comprising a thin core having a pair of opposing major planar sides. A plurality of sets of code fields are printed on a first side of the core. Each set of code fields is printed with a numeric code unique to the set. At least a first code field of each code field set is printed with the unique numeric code in at least a bar format. At least a second code field of each code field set is printed with the unique numeric code in at least a numeral format. The second code field of each set is spaced from the first code field of the set. Each of the codes in the first code field of each code field set is printed in a first direction across the first side of core. Each of the codes in the second code field of each code field set is printed in a direction transverse to the first direction of the first code field of the set.

BRIEF DESCRIPTION OF THE DRAWINGS

The foregoing summary, as well as the following detailed description of the presently preferred embodiments of the invention, will be better understood when read in conjunction with the appended drawings. It should be understood, however, that this invention is not limited to the precise arrangements illustrated. In the drawings.

DETAILED DESCRIPTION OF PREFERRED EMBODIMENTS

Figure 1:
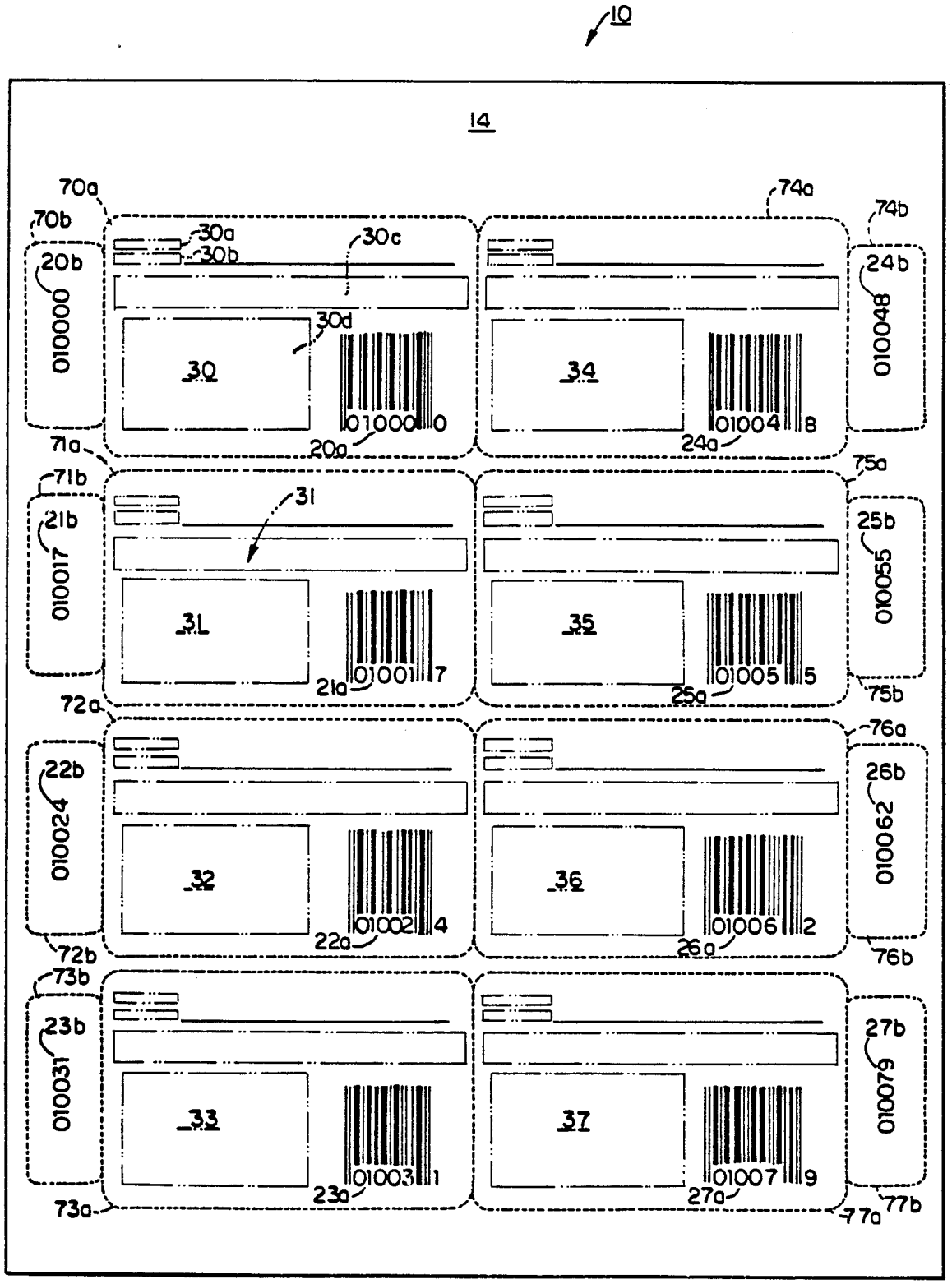
FIG. 1 depicts diagrammatically a first major planar side of a first printed sheet product of the invention.
Figure 2:
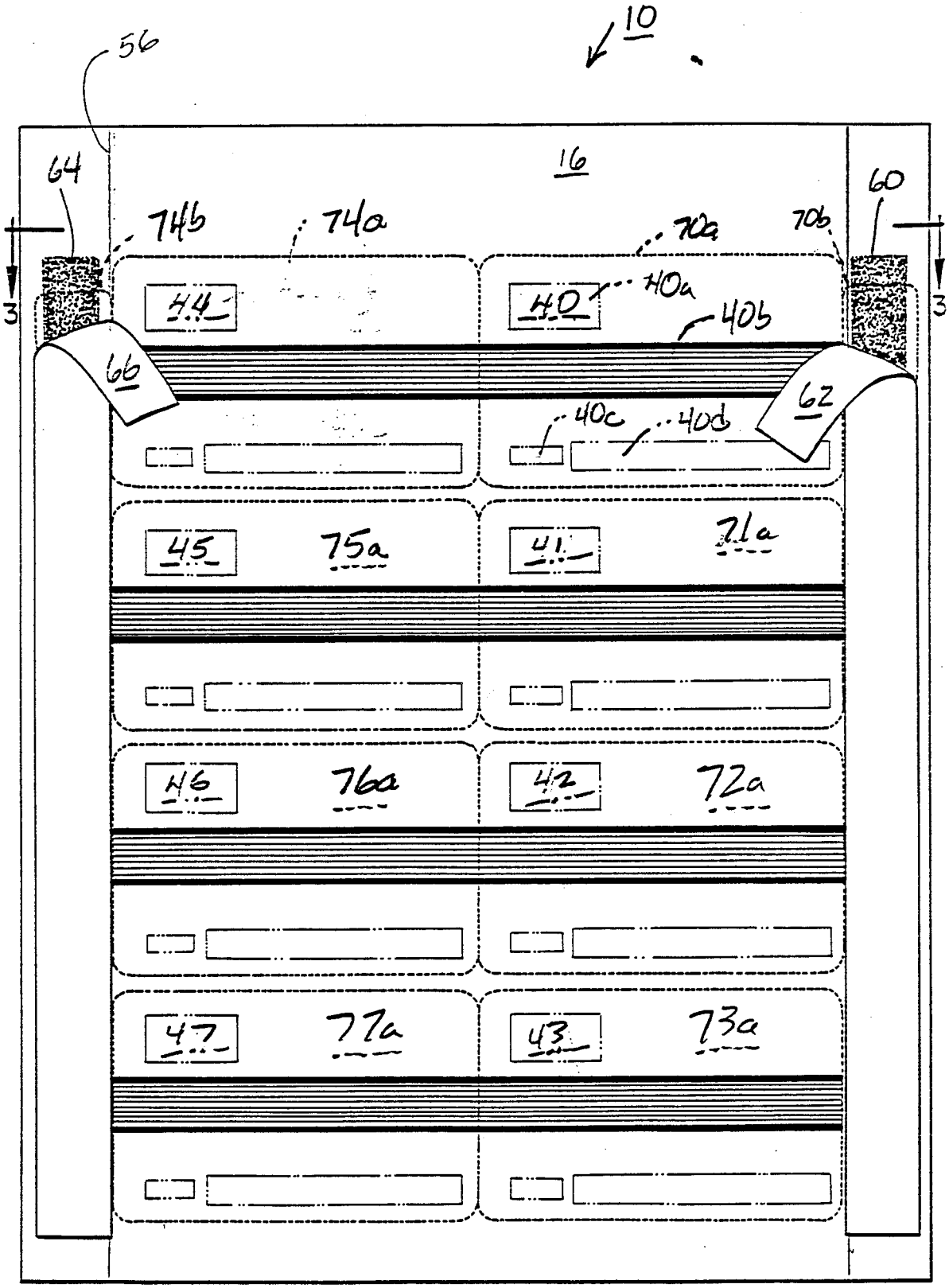
FIG. 2 depicts diagrammatically a second major planar side of the sheet product of FIG. 1.
Figure 3:
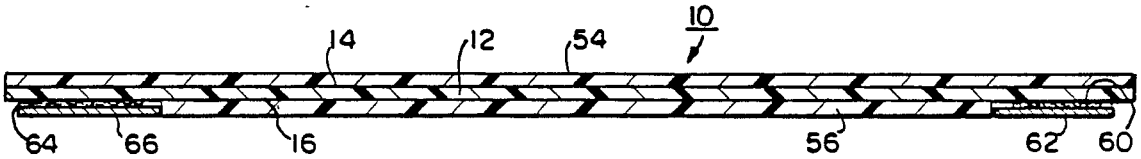
FIG. 3 depicts diagrammatically a cross section through the sheet products of FIGS. 1 and 2 along the lines 3—3.

FIGS. 1, 2 and 3 depict, in varying views, a first printed sheet product of the present invention indicated generally at 10. The product 10 includes a thin, flexible core 12 (see FIG. 3) which is, in this embodiment, the size of the product 10 depicted in FIGS. 1 and 2 and which has two major planar opposing sides 14 and 16. As will be seen, core sides 14 and 16 effectively form the imprinted sides of the product 10 as well. Side 14 is depicted in FIG. 1. Side 16 is depicted in FIG. 2.

Referring to FIG. 1, there is printed on the first major side 14 of the core 12, a plurality of sets of code fields. In the depicted product 10, eight code field sets of two code fields each are preferred but larger or smaller numbers of code field sets with equal or larger numbers of code are possible. A first code field of each of the eight code field sets is identified generally at 20*a* through 27*a*, respectively, while a second code field of each of the eight code field sets is indicated generally at 20*b* through 27*b*, respectively. Printed in each of the first code fields 20*a* through 27*a* and second code fields 20*b* through 27*b* are numeric codes, examples of which are actually shown on FIG. 1. The code of each of the eight sets of code fields 20*a* and 20*b*, 21*a* and 21*b*, etc., is unique to the set and differs from the numeric code of each of the remaining sets of fields printed on the first side 14 of the core 12. In the depicted example, each code has six decimal digits. The first five digits are sequential between 01000 and 01007. The sixth digit in each code is a check digit. The six digit codes are merely examples. More or fewer digits and even letters and other symbols can be incorporated into the codes, although it will be appreciated that letters and other symbols will not appear in the bar format representation of the codes. Also, although it is a preferred method of encoding, the unique codes need not be numerically sequential, merely different.

The unique, numeric code of each set of code fields is printed in at least bar format and, preferably, in both bar and numeral formats in the first code field 20*a* through 27*a*, respectively, of each of the eight sets of code fields. The same numeric code of the set preferably is printed in at least numeral format in the second code field 20*b* through 27*b* of each set of code fields as indicated. The second code field 20*b* through 27*b* of each code field set is spaced from the first code field of the set, 20*a* through 27*a*, respectively, on the first side 14 of the core 12 and the sheet product 10.

Also printed on the first side 14 of the core 12 are a first plurality of static graphic fields, represented by various dot and dashed blocks, indicated collectively at 30 through 37, respectively. Such fields typically contain text and/or graphic designs. In the embodiment being depicted, each static graphic field has four separate components, numbered individually for a first of the fields 30 as 30*a*, 30*b*, 30*c*, 30*d*. The numbers and locations of the components of the static graphic fields are not significant per se to the invention. The static graphic fields 30–37 are usually identical to one another, but need not be so. Preferably, the number of static graphic fields 30–37 printed is at least equal the number of sets of code fields, in this case eight, whereby one of the static graphic fields 30–37 is associated with a separate one of the code field sets. One of the code fields of each of the sets of code fields is positioned substantially identically with respect to one of the static graphic fields 30–37. In this case, the first code field 20*a*–27*a* of each set of code fields is located in the same position with respect to each of the static graphic fields 30–37, slightly below and to the right of the various components of the static fields 30–37, for reasons which will be apparent.

One important feature of the invention is the printing of the code fields 20*a*–27*a* and 20*b*–27*b* in different directions on the same side of the sheet 10. One or more of the components of the static graphic fields 30–37 printed on the first side 14 of the core 12 typically contains text which is printed left to right across the sheet 10 when sheet 10 is viewed in the orientation it is presented in FIG. 1 with its shorter sides horizontal and located at the top and bottom of the sheet 10. As can be seen in FIG. 1, the bar and numeral format codes in the first code fields 20*a*–27*a* are printed in a first direction, namely the horizontal direction in each of those first code fields. The numeral format codes in each of the second plurality of code fields 20*b*–27*b* are printed in a direction transverse to the horizontal direction of the corresponding first code field 20*a*–27*a* of each set, preferably in a vertical direction, perpendicular to the horizontal direction in which the codes of the first plurality code fields 20*a*–27*a* are printed. While perpendicular directions are preferred for the first direction and the transverse direction in which the code sets are printed, the first and transverse directions need not be perpendicular. Nor do the first code fields all have to be printed in the same first direction, even though such an orientation is usually employed, nor do the second code fields have to be printed in the same transverse direction. As was indicated above, the first code field 20*a*–27*a* of each set of code fields is located in the same orientation and position, namely, partially below and partially to the right of a proximal one of the first plurality of static graphic fields 30–37, respectively. This conveniently permits the static graphic fields 30–37 and first code fields 20*a*–27*a* to be grouped together to produce an identical plurality of removable elements, as will be shortly described.

Referring to FIG. 2, the second side 16 of the core 12 is printed with a second plurality of static graphic fields, each field being indicated collectively at 40–47, respectively. Each of the second static graphic fields 40–47 in the depicted embodiment includes, for example, four separate components indicated by rectangular dot dashed lines and shading. These are numbered individually for the first field 40 as 40*a*, 40*b*, 40*c* and 40*d* for clarity. Again, the details of the second plurality of static graphic fields are immaterial. Typically, each of the second plurality of static graphic fields 40–47 is identical to one another and positioned identically opposite a separate one of the first code fields 20*a*–27*a* and a separate one of the first plurality of static graphic fields 30–37 on the first side 14 of the core 12.

Preferably, after printing, there is applied to the first side 14 of the core 12, a first covering which is indicated generally at 54 in FIG. 3. Its edges can be seen in FIG. 2 and one edge is numbered. The first covering 54 suggestedly covers at least a central portion of the first side 14, overlying all of the code fields 20*a*–27*a* and first static graphic fields 30–37. In this embodiment, the first covering 54 preferably extends to the long side edges of the core 12 covering the second printed code fields 20*b*–27*b* as well. The covering 54 is at least sufficiently transparent to read the underlying printed fields 20*a*–27*a*, 20*b*–27*b* and 30–37. A second covering 56 is preferably applied to the second side 16 of the core 12. Preferably, the second covering overlies only a central portion of the second side 16 containing at least a major portion of the second plurality of static graphic fields 40–47 printed on the second side. Preferably, the second covering is directly opposite at least the first plurality of code fields 20*a*–27*a* and at least most if not all of the first plurality of printed static fields 30–37. Again, the second covering 56 is at least sufficiently transparent to read the underlying printed static fields 40–47.

Also, preferably applied to the second side 16 of the core 12 are two stripes 60 and 64 of pressure sensitive adhesive. Preferably, the stripes 60 and 64 are applied directly opposite the second code fields 20*b*–23*b* and 24*b*–27*b*, respectively. In the embodiment of the invention depicted in FIGS. 1 through 3, strips of release paper 62 and 66 directly overlie the stripes of pressure sensitive adhesive 60 and 64, respectively.

The sheet product 10 is scored through the core 10 and, where present, the first covering 54, second covering 56 and adhesive layer 60, 64. This scoring is indicated by diagrammatically by unnumbered, bold dotted lines in FIGS. 1 and 2. The scoring defines a plurality of sets of elements which are removable from the sheet product 10. In particular, eight sets of removable elements, a number of sets equal to the numbers of sets of code fields, first plurality of static graphic fields and second plurality of static graphic fields printed on the core 12, are provided in product 10 by the scoring. Preferably, a first removable element of each of the eight sets of removable elements is a generally rectangular, transaction card sized element and is indicated at 70*a*–77*a*. Each of the card sized elements 70*a*–77*a* includes on one side, which is the second side 16 of the core 12 and product 10, a substantially identical portion of one of the second plurality of static graphic fields 40–47 which was printed on that side. Each element 70*a*–77*a* also includes on an opposing side, which is the first side 14 of the core 12 any product 10, a separate, substantially identical portion of one of the first plurality of static graphic fields 30–37 and an at least one of the first and second plurality of code fields, preferably, the first plurality of code fields 20*a*–27*a*. The elements 70*a*–77*a* can be used as a credit card, identification card, membership card, etc.

The second removable element of each set is denoted at 70*b*–77*b* and consists of a portion of the product 10 having on one side, which was the first side 14 of the core 12 and product 10, one of the second set of code fields 20*b*–27*b*, respectively. Each removable element 70*b*–77*b* includes on its remaining side, which was the second side 16 of the core 12 and product 10, a portion of one of the two stripes 60 and 64 of pressure sensitive adhesive. Elements 70*b*–77*b* can be used as labels or tabs on an application or membership form, etc., of the person receiving the corresponding card element 70*a*–77*a* of the set.

The scoring has been indicated diagrammatically for several reasons. First, the exact type of scoring used, e.g., long, continuous cuts with short breaks or short, closely spaced perforations, etc. is a matter of choice. The former, long continuous cuts with short breaks in the cuts to leave a solid piece of the product 10 between adjoining ends of the cuts, is presently preferred. Furthermore, the product 10 without the scoring and without the release paper strips 62 and 66, is an intermediate sheet product which can be used to make a somewhat different sheet product indicated generally at 110 in FIGS. 4 through 6.

Figure 4:
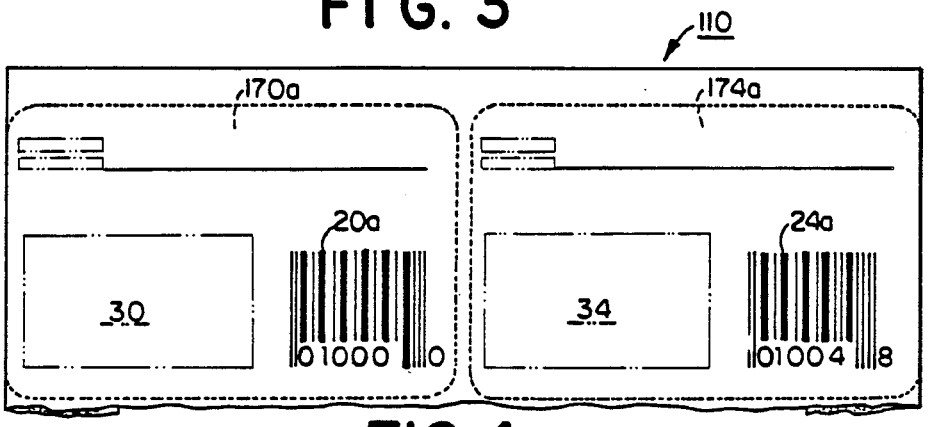
FIG. 4 depicts diagrammatically part of a first side of a second printed sheet product.
Figure 5:
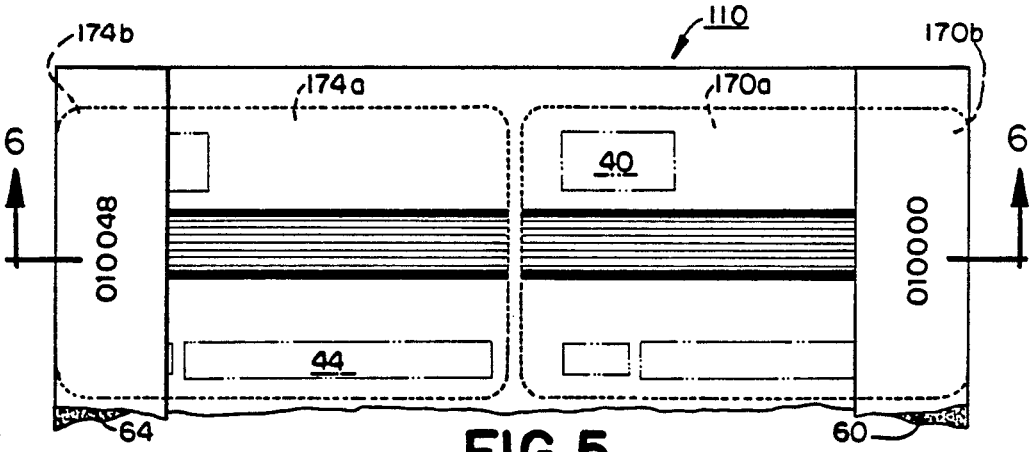
FIG. 5 depicts diagrammatically part of a second, opposing side of the sheet product of FIG. 4.
Figure 6:
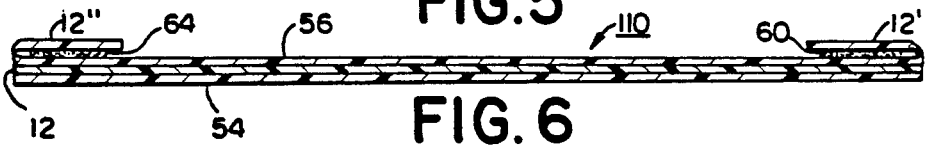
FIG. 6 depicts diagrammatically a cross section through the second sheet product of FIGS. 4 and 5 along the lines 6—6.

Product 110 in FIGS. 4 through 6 is so similar to the sheet product 10 of FIGS. 1 through 3 that only a top portion of product 110 is shown in FIGS. 4 and 5 to highlight the differences between the two embodiments 10 and 110. The sheet product 110 is formed from an intermediate sheet product also used to form the sheet product 10 of FIGS. 1 through 3. That intermediate product includes the core 10, the pluralities of code fields 20*a*–27*a* and 20*b*–27*b* and the first plurality of static graphic fields 30–37 printed on the first side 14 of the core 12 (FIG. 4) and the second plurality of static graphic fields 40–47, respectively, printed on the second side 16 of the core 12. Stripes 60 and 64 of pressure sensitive adhesive are also provided along the second side 16 of the core 12 adjoining the longer side edges of the core 12 and directly opposite the second code fields 20*b*–23*b* and 24*b*–27*b*, respectively, only fields 20*b* and 24*b* being indicated in FIG. 4. This intermediate sheet product is therefore identical to the sheet product 10 of FIGS. 1–3 except that it lacks the strips of release paper 62 and 66 and the scoring. The side edge portions of the first covering 54, overlying the second code fields 20*b*–27*b* can also be eliminated as a cost savings. This intermediate product is indicated in Fig. at 100.

Figure 7:
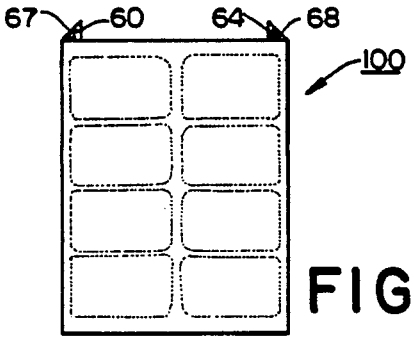
FIG. 7 depicts diagrammatically an intermediate step in making the sheet product of FIGS. 4–6.

In converting this intermediate product 100 into the sheet product 110 of FIGS. 4–6, the first and second longitudinal edge portions 67 and 68 of the core 12, bearing the adhesive stripes 60 and 64, respectively, of the sheet product 100 are turned, as is indicated diagrammatically in FIG. 7, unto an adjoining portion of the core 12 and sheet product 100 forming a double thickness of the core 12 along the longitudinal edges of the resulting sheet product 110 part of which is indicated in FIG. 6. The sheet product 110 formed in this manner is thereafter scored, the scoring again being indicated by the unnumbered, bold dotted lines in FIGS. 4 and 5. The scoring defines plural sets of plural elements removable from the sheet product 110 and removably adhered to one another by the intervening adhesive stripe 60 or 64. In the depicted embodiment 110 continuous cuts have been made along the longer, folded side edges of the intermediate product 100 to define the outer side portions of the removable elements 170*a*, 170*b* and 174*a*, 174*b* and to remove the longitudinal folds formed along the longitudinal side edges of the intermediate product 100.

Two of the plural sets of removable elements are seen in FIGS. 4 and 5 and indicated at 170*a*, 170*b* and 174*a*, 174*b*, respectively. The first element 170*a*, 174*a* of each depicted set of removable elements is again, preferably, a generally rectangular, transaction card sized element bearing most or all of the first and second static graphic fields 30, 34 and 40, 44, respectively, and a separate one of the first plurality of code fields 20*a* and 24*a*, respectively. Each second element 170*b* and 174*b* of each set of removable elements bears one of the second plurality of printed code fields 20*b* and 24*b* of each of the printed code sets printed on the sheet product 110.

Again, scoring is indicated diagrammatically, as different arrangements may be preferred and used. For example, the spacing provided between elements 170*a* and 174*a* and between each of those elements and the next adjoining sets of removable elements (not depicted) on the product 110 might be desired to permit the use of mating male/female dies as multiple thicknesses of the core material 12 are now provided along the opposing sides of the product 110 (see FIG. 6).

If desired, the scoring along the vertical sides of the product 110 can run intermittently from the top to the bottom narrow edge of the product 110 and the side edges containing the folds provided in the intermediate product 100 retained on the product during and after the scoring step. Preferably, six more sets of removable elements would be formed on the sheet product 110, each set of removable elements bearing its own unique set of printed numeric codes, in the same way that eight total sets of removable elements 70*a*–77*a* and 70*b*–77*b* are formed on the sheet product 10 of FIGS. 1–3. Again, the exact numbers of sets of removable elements and number of elements in each set is not critical.

The core 12 of each sheet products 10 and 110 can be any thin sheet or web material having two major planar opposing sides, which can be printed upon. Preferably, the core is a flexible material which can be used with conventional, high speed, offset printing machines. Acceptable materials include metal foils, cellulose based products, fabrics, cloths and preferably plastics including, for example, ABS, acetates, butyrates, phenolics, polycarbonates, polyesters, polyethylenes, polypropylenes, polystyrenes, polyurethanes and polyvinyl chlorides as monomers, copolymers and/or laminates. For example, the following specific trademarked products may be useful: Polyart I and II of Arjobex Synthetic Papers; various grades of GP700 from Bexford Limited (Engl.); Kapton, Tedlar and Telar of DuPont; Fascal, Fasprint and Crack n' Peel Plus of Fasson; Lasercal, Compucal II and Datacal Coating of Flexcon; Kimdura of Kimberly Clark; various grades of Pentaprint PR of Klockner Pentaplast; various grades of LLM-LV and Data Graphic II LLM of Lamart; Teslin of PPG Industries; the following products of Stanpat: APL-100, -110, -120, -150, -200, UM-546, UC-546, PPC-410, -450 and -460; and the following products of Transilwrap: Proprint, Transilprint, Transilmatte, T.X.P., Eve, Trans-Alley, Transglaze, Trans-AR, Trans V.L. and T Print; and others. These brand name products are treated or constructed in some fashion to make them particularly suited for use in one or more types of printing processes. Details regarding these products and companies and others are available to those of ordinary skill in the art through various sources including but not limited to published references such as *AUTOMATED ID NEWS* 1989–1990 *REFERENCE GUIDE AND DIRECTORY*, published and distributed by Edgell Publications, Cleveland, Ohio.

Each of the first and second coverings 54 and 56 can be any material which is transparent and which can be applied to the core material selected in any suitable fashion for the material(s) selected without adversely affecting the core or the printing thereon. The coverings might be, for example, sheets or webs of any of a variety of transparent Transcote FG and Copolymer plastic films of Transilwrap, Inc. of Chicago, Ill. or any of a variety of transparent Durafilm plastic films of Graphic Laminating, Inc. of Cleveland, Ohio. The plastic films are preferably adhered to the core with an adhesive appropriate for use with the materials selected for the core and transparent covering. Typically, polymer based adhesives are used with the exemplary plastic films identified above.

For the particular removable elements being made in the preferred embodiments disclosed in this application, namely, transaction size cards and labels, the above-identified coverings are preferred, as they provide a layer of polyester having good strength, wear and soil resistant properties which can be used on the outer side of the products 10, 100, 110. The pressure sensitive adhesive used may be any conventional, commercially available, pressure sensitive contact adhesive suitable for use with the particular materials selected for the sheet product. For the embodiments being described, double coated, permanent adhesive transfer tapes, such as those available from Enterprise Tape Company of Dalton, Ill., for example, are suitable.

The preferred methods of manufacturing the preferred sheet products 10, 100 and 110 are quite similar and straightforward. Preferably, the static graphic fields are printed first on each selected side of the core material selected. Any known, conventional type of printer and printing process may be used including, for example, flexographic, offset lithographic, silkscreen, letter press, thermal transfer, thermal direct, ink jet, color laser, formed character impact, hot stamp, electro-static, ion deposition, magnetographic, dot matrix, cycolor, photographic (silver haylite), sublimation, diffusion, pad, gravure, spray painting, dyeing, electrolytic plating, electroless plating, sputter deposition, in-mold decorating, flocking, embossing, vacuum evaporation metalizing, engraving and hot transfer. Preferably, a high speed printing process such as flexographic or offset lithography is used to print on continuous webs of thin flexible planar material for efficiency and cost. A printing method and machine capable of simultaneously printing the first and second sets of static graphic fields on the first and second sides of the web in one pass through the printer is preferred for efficiency, but single side printing in separate passes may be preferred for quality. Next, the core bearing the printed static graphic fields preferably is passed through a code field printer, preferably a programmable printer capable of printing variable data fields in at least bar and character format on one side of the core, which becomes the first side of the sheet products, in a single pass of the core through that printer. Character refers to at least numbers. Commercially available printers having this capability include thermal transfer, thermal direct, ink jet, color laser, formed character impact, electro-static, ion deposition, magnetographic, dot matrix, photographic and sublimation and are available from almost an innumerable list of suppliers. Again, printers printing on continuous webs are preferred for efficiency but printers printing on individual sheets (cut lengths of web) are preferred for quality. Currently, thermal transfer and laser printers are preferred in the industry for variable format printing, particularly of characters and bar codes. Generally speaking, existing thermal transfer printers provide high quality, sharp characters and bars while laser printers provide characters and bars which are not as sharp but more consistent in thickness. Improvements continue to be made to both ink jet and ion deposition printers as well. Ink jet and/or ion deposition printers may be preferred for speed. However, at least currently available machines, generally speaking, do not provide the quality provided by currently available thermal transfer and laser printers. Currently, laser printing is preferred for the particular embodiments 10, 100 and 110 being described. Again, the material selected for the core 12 should be compatible with the preferred printing method and equipment or the printing methods and equipment selected to be compatible with a preferred material.

The programmable code field printer selected preferably is configured to print each of the first plurality of code fields 20*a*–27*a* in a first direction and the second plurality of code fields 20*b*–27*b* in a direction transverse to the first direction of the first code field of the set on the one side of the sheet or web constituting the first side 14 of the core 12. As is indicated in FIGS. 1, 2 and 4, 5 there, the bars and numerals of the first plurality of code fields 20*a*–27*a* are printed in a portrait mode running horizontally across the sheet 10, while the second plurality of code fields 20*b*–27*b* are printed in a landscape mode running vertically along the side edges of the sheet 10. This is accomplished in straightforward fashion by simply programming the computer to identify the characters to be printed at predetermined locations on the web in defined angular orientations to the web. In this way, all of the code fields are printed on the web in a single pass of the web through the printer. Preferably, the first and second coverings 54 and 56 are then applied to the opposing sides 14 and 16 of the web in a conventional manner for the covering material selected. The stripes of pressure sensitive adhesive 60 and 64 are also applied, with or without release paper 62 and 66, respectively, for the embodiment 10, 100 or 110 selected. Next, if the first embodiment sheet product 10 is produced, the printed, covered web is preferably fed through a cutter which scores the sheet products 10 through the core 12, covering 54 and 56 and stripes 60 and 64, where present, to define the sets of removable elements 70*a*–77*a* and 70*b*–77*b* and cuts a continuous web into the individual sheet product lengths if a continuous web is used. If the second embodiment sheet product 110 is being made, the side edge portions 67, 68 bearing the pressure sensitive adhesive strips 60 and 64 are folded by conventional stock folding equipment upon an immediately adjoining central portion of the web. The longitudinal edge folded web product is thereafter preferably fed through a cutter which scores each of the individual sheet products 110 to define the plurality of sets of removable elements 170*a*–177*a* and 170*b*–177*b* and cuts the continuous web into the individual sheet product lengths 110 if a continuous web is used.

It will be recognized by those skilled in the art that changes could be made to the above-described embodiments. For example, in addition to printing unique code fields for each associated set of elements, other fields can be reserved for printing other data uniquely associated with the code or with the person or entities ultimately assigned the codes, for example, names, addresses, phone numbers, dates, vital statistics, etc. Many if not most programmable printers are capable of reading such data from a conventional data storage device, such as a tape drive, disk drive, etc. and printing the information in fields which are predefined with respect to the core 12 and, preferably, with respect to one or more of the removable elements which are ultimately defined on the core.

Also, although one transaction sized laminated card and one adhesive back tab or label have been identified in the disclosed embodiments as constituting each set of removable elements, additional and/or alternate elements can be provided. For example, multiple transaction sized cards, multiple labels, and other elements including, for example, an element having a hole or opening cut therethrough for attachment to a key ring, hook or the like, can be provided.

One of ordinary skill will appreciate the order in which steps are taken may be immaterial. For example, while printing a static graphic field initially on a continuous web is preferred for rapid, inexpensive printing, static fields can be printed directly on cut sheets. Typically, it will also be immaterial whether the code fields are printed before or after the static graphic fields. Further, the order in which coverings are applied is generally not critical, and coverings could be applied to one side of a core after printing upon that side is completed and before printing is performed on the other side of the core.

It will be recognized by those skilled in the art that other changes can be made to the above-described embodiment disclosed and suggested without departing from the broad, inventive concepts thereof. It should be understood, therefore, that this invention is not limited to the particular embodiments disclosed, but is intended to cover any modifications which are within the scope and spirit of the invention as defined by the appended claims.

We claim:

1. A method of making a printed sheet product comprising the steps of:

printing a plurality of sets of code fields on a first of two opposing major planar sides of a thin core, each set of code fields being printed with a numeric code unique to the set, the unique numeric code of each code field set being printed in at least a bar format in at least a first field of each set and in at least a numeral format in at least a second field of each set, the second code field of each set being spaced from the first code field of the set on the first side of the core; and applying a layer of adhesive to at least part of a side of the core opposite at least part of at least one of the first and second fields of each code set printed on the first side of the core.

2. The method of claim 1 further comprising the step of scoring the core and the adhesive where present to define a plurality of sets of elements removable from the core, each set of elements comprising a first removable element bearing one of the first plurality of code fields printed on the sheet and a second, separate, removable element of the set of removable elements bearing the second code field of the code field set printed on the sheet.

3. The method of claim 1 wherein the printing step comprises printing the plurality of code fields on the first side of the planar core in one pass across the first side of the core.

4. The method of claim 3 wherein the printing step further comprises printing the numeric codes of the second plurality of code fields in a direction perpendicular to a first direction in which the first plurality of code fields is printed.

5. The method of claim 1 further comprising a separate step of printing on the first side of the core at least a first plurality of at least substantially identical, static graphic fields at least equal in number to the plurality of code sets printed on the first side of the core, the static graphic fields being located such that at least one of the first and second code fields of each of the plurality of sets of code fields on the first side of the core is in the same orientation and position with respect to a separate proximal one of the first plurality of static graphic fields.

6. The method of claim 5 comprising the steps of printing at least a second plurality of at least substantially identical static graphic fields on the second side of the core, each of the second plurality of static graphic fields being identically opposite at least one of the first and second code fields of each code set printed on the first side whereby an identical part of each of the second plurality of static graphic fields and at least one of the first and second code fields of each set of code fields are directly and identically opposite one another on the second and first sides of the core.

7. The method of claim 1 further comprising applying a first covering to the first side of the core overlying at least part of the first plurality of printed code fields, the first covering being sufficiently transparent to read the underlying printed code fields.

8. The method of claim 7 further comprising applying a second covering to the second side of the core and scoring at least one generally rectangular, transaction card sized removable element for each of the plurality of code sets, each of the transaction card sized removable elements having a first side covered with the first layer and bearing a first printed code field and a second side covered with the second layer.

9. The method of claim 1 wherein the applying step further comprises applying the layer of adhesive along an edge portion of one of the first and second sides of the core and further comprising the steps of:

turning the edge portion of the core with pressure sensitive adhesive onto an adjoining portion of the core; and scoring through the turned edge portion and the adjoining portion of the core simultaneously to define at least two elements removably adhered together and removable from the core for each set of printed code fields.

10. The sheet product produced by the method of claim 1.

11. The sheet product produced by the method of claim 2.

12. The sheet product produced by the method of claim 8.

13. The sheet product produced by the method of claim 9.

14. A method of making a printed sheet product comprising the steps of:

printing a plurality of sets of code fields on a first of two opposing major planar sides of a thin core, each set of code fields being printed with a numeric code unique to the set, the unique numeric code of each code field set being printed in at least a bar format in at least a first field of each set and in at least a numeral format in at least a second field of the set, the second code field of each set being spaced from the first code field of the set on the first side of the core, each of the codes being printed in the first code field of each code set in a first direction across the first side of the core and each of the codes being printed in the second field of each set in a second direction transverse to the first direction; and scoring the core to define a plurality of sets of elements removable from the core, a first element of each set of the removable elements bearing the first code field of one of the sets of code fields, and a second element of each set bearing the second code field of the one set of code fields.

15. The sheet product produced by the method of claim 1.

16. A printed sheet product comprising:

a thin core formed by a single sheet of material having a pair of opposing major planar sides; and a plurality of sets of code fields printed on a first side of the core, each set of code fields being printed with a numeric code unique to the set, at least a first code field of each set being printed with the unique numeric code in at least a bar format and at least a second code field of each code field set being printed with the unique numeric code in at least a numeral format, the second code field of each set being spaced from the first code field of the set, each of the codes in the first field of each code field set being printed in a first direction across the first side of the core and each of the codes in the second code field of each code set being printed in a direction transverse to the first direction of the first code field of the set.

17. The printed sheet product of claim 16 further comprising a layer of adhesive applied to at least part of a side of the sheet product opposite at least part of at least one of the first and second fields of each code field set printed on the first side of the core.

18. A printed sheet product comprising:

a thin core formed by a single sheet of material having a pair of opposing major planar sides;

a plurality of sets of code fields printed on a first side of the core, each set of code fields being printed with a numeric code unique to the set, the unique numeric code of each code field set being printed in at least a bar format in at least a first field of each set and in at least a numeral format in at least a second field of each set, the second code field of each set being spaced from the first code field of the set on the first side of the core; and a layer of pressure sensitive adhesive applied to at least part of a second side of the sheet product directly opposite at least part of at least one of the first and second fields of each code set printed on the first side of the core.

* * * * *

US004978146B1

REEXAMINATION CERTIFICATE (3771st)

United States Patent [19]

Warther et al.

[11] B1 4,978,146

[45] Certificate Issued Jun. 1, 1999

[54] METHOD FOR MAKING UNIQUELY ENCODED TRANSACTION CARDS AND RELATED SHEET PRODUCTS

[75] Inventors: Richard O. Warther, West Chester; Raymond Steen, Jr., Chester Springs, both of Pa.

[73] Assignee: Vanguard Identification Systems, Inc., Exton, Pa.

Reexamination Request:
No. 90/005,002, May 29, 1998

Reexamination Certificate for:

| | |
|---|---|
| Patent No.: | **4,978,146** |
| Issued: | **Dec. 18, 1990** |
| Appl. No.: | **07/502,005** |
| Filed: | **Mar. 30, 1990** |

[21] Appl. No.: 07/502,005

[51] Int. Cl.[6] ..... B42D 15/00

[52] U.S. Cl. ..... 283/81; 40/630; 101/369; 283/109; 283/117; 283/904

[58] Field of Search ..... 40/630, 638; 101/369, 101/483; 156/269, 289, 324; 283/60.1, 74, 81, 109, 904

[56] References Cited

U.S. PATENT DOCUMENTS

| | | |
|---|---|---|
| 1,795,291 | 3/1931 | Dunn . |
| 1,957,374 | 5/1934 | Unger . |
| 2,098,164 | 11/1937 | Rice . |
| 2,256,399 | 9/1941 | MacHarg . |
| 2,312,204 | 2/1943 | Weindel, Jr. . |
| 2,326,939 | 8/1943 | Grafsland . |
| 2,357,641 | 9/1944 | Evalt . |
| 2,363,472 | 11/1944 | Ritter . |
| 2,578,548 | 12/1951 | Histed . |
| 2,616,612 | 11/1952 | Guttman . |
| 2,812,601 | 11/1957 | Hines . |
| 2,865,120 | 12/1958 | Hines . |
| 3,062,431 | 11/1962 | Rabenold . |
| 3,068,140 | 12/1962 | Biddle . |
| 3,087,267 | 4/1963 | Gustafson . |
| 3,093,296 | 6/1963 | Wood . |
| 3,130,509 | 4/1964 | Brooks . |
| 3,140,818 | 7/1964 | Sheldon . |
| 3,152,901 | 10/1964 | Johnson . |
| 3,211,470 | 10/1965 | Wilson . |
| 3,216,743 | 11/1965 | Morrow et al. . |

(List continued on next page.)

FOREIGN PATENT DOCUMENTS

| | | |
|---|---|---|
| 776047 | 1/1968 | Canada . |
| 0024344 | 1/1968 | European Pat. Off. . |
| 1594331 | 6/1970 | France . |
| 2225001 | 10/1974 | France . |
| 2557338 | 7/1985 | France . |
| 2-265796 | 10/1990 | Japan . |
| 1 548 588 | 7/1979 | United Kingdom . |
| 2213770 | 8/1989 | United Kingdom . |
| WO 8404493 | 11/1984 | WIPO . |
| 89/07052 | 8/1989 | WIPO . |

OTHER PUBLICATIONS

Catalog sheet The Prodigy Label Printer™, Fargo Electronics Incorporated, Prairie, MN 1990, 2 sides.

H. Bailey and B. Wray, "Photographic Bar Code Labels", *Identification Journal,* Jan./Feb. 1988, pp. 16–19.

*Primary Examiner*—Hwei-Siu Payer

[57] ABSTRACT

A printed sheet product comprises a thin core having a pair of opposing major planar sides. A plurality of sets of code fields are printed on a first side of the core. Each set of code fields is printed with a numeric code unique to the set. At least a first code field of each code field set is printed with the unique numeric code in at least a bar format. At least a second code field of each code field set is printed with the unique numeric code in at least a numeral format. The second code field of each set is spaced from the first code field of the set. A sheet product further comprises a layer of pressure sensitive adhesive applied to at least part of at least one side of the sheet product directly opposite at least part of at least one of the first and second code fields of each code field set printed on the first side of the core.

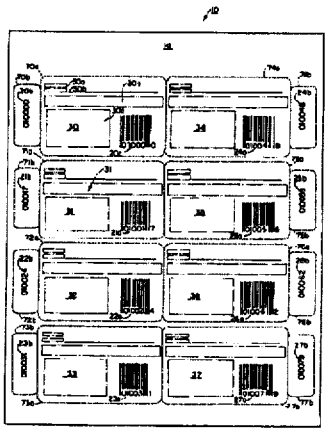

U.S. PATENT DOCUMENTS 3,226,862 1/1966 Gabruk .
3,228,129 1/1966 Gwinn et al. .
3,230,649 1/1966 Karn .
3,350,799 11/1967 Japs .
3,364,049 1/1968 Deak et al. .
3,461,581 8/1969 Hoffmann .
3,583,317 6/1971 Gibson .
3,674,622 7/1972 Plasse .
3,676,644 7/1972 Vaccaro et al. .
3,679,448 7/1972 Tramposch .
3,679,449 7/1972 Nagot et al. .
3,684,869 8/1972 Reiter .
3,697,101 10/1972 Loos et al. .
3,716,439 2/1973 Maeda ..... 156/269
3,716,440 2/1973 Ando et al. .
3,808,718 5/1974 Christiansen .
3,820,261 6/1974 Beall, Jr. ..... 40/639
3,895,220 7/1975 Nelson et al. .
3,946,507 3/1976 Fergg et al. .
3,950,870 4/1976 Heegaard .
3,963,124 6/1976 Banks .
3,995,087 11/1976 Desanzo .
3,999,700 12/1976 Chalmers .
4,006,050 2/1977 Hurst et al. .
4,109,143 8/1978 Yamaguchi et al. .
4,149,305 4/1979 Blumhof .
4,204,639 5/1980 Barber et al. .
4,214,463 7/1980 Blumhof .
4,271,352 6/1981 Thomas .
4,306,433 12/1981 Kelly .
4,425,772 1/1984 Brewer .
4,521,981 6/1985 Kasprzycki et al. .
4,523,088 6/1985 Utsch et al. .
4,536,013 8/1985 Haghiri-Therani et al. .
4,589,687 5/1986 Hannon ..... 283/94
4,594,125 6/1986 Watson .
4,630,067 12/1986 Teraoka .
4,631,845 12/1986 Samuel et al. ..... 40/638
4,637,635 1/1987 Levine .
4,637,712 1/1987 Arnold et al. .
4,641,347 2/1987 Clark et al. .
4,653,775 3/1987 Raphael et al. .
4,712,929 12/1987 Kitaoka .
4,746,830 5/1988 Holland .
4,765,653 8/1988 Fasham et al. .
4,824,142 4/1989 Dossche .
4,842,304 6/1989 Jones .
4,854,610 8/1989 Kwiatek .
4,857,121 8/1989 Markley et al. .
4,869,946 9/1989 Clay .
4,887,763 12/1989 Sano .
4,889,367 12/1989 Miller .
4,904,853 2/1990 Yokokawa .
4,986,868 1/1991 Schmidt ..... 156/249
4,995,642 2/1991 Juszak et al. .
5,078,828 1/1992 Marglin .
5,114,187 5/1992 Branch .
5,165,726 11/1992 Talbott .
5,195,123 3/1993 Clement ..... 378/166
5,271,643 12/1993 Hafele .

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 6–9, 12 and 13 is confirmed.

Claims 1–5, 10, 11 and 14–18 are cancelled.

* * * * *